US011083943B2

(12) United States Patent
Parmeter

(10) Patent No.: US 11,083,943 B2
(45) Date of Patent: Aug. 10, 2021

(54) RING TOSSING GAME AND GAME APPARATUS

(71) Applicant: Eric John Parmeter, Morgantown, WV (US)

(72) Inventor: Eric John Parmeter, Morgantown, WV (US)

( * ) Notice: Subject to any disclaimer, the term of this patent is extended or adjusted under 35 U.S.C. 154(b) by 0 days.

(21) Appl. No.: 16/513,333

(22) Filed: Jul. 16, 2019

(65) Prior Publication Data

US 2020/0023256 A1 Jan. 23, 2020

Related U.S. Application Data

(60) Provisional application No. 62/716,934, filed on Aug. 9, 2018.

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
None
See application file for complete search history.

(56) References Cited

U.S. PATENT DOCUMENTS 145,914 A * 12/1873 Smith ..... A63B 67/06 273/338
659,352 A * 10/1900 Park ..... F41J 3/0047 273/348.5
731,192 A * 6/1903 Lewis ..... A63B 67/06 273/338
939,580 A * 11/1909 Young ..... A63B 67/06 273/338
1,501,942 A * 7/1924 Carman ..... A63B 67/06 273/339
1,557,788 A * 10/1925 Atkin ..... A63F 9/0208 273/338
4,045,028 A * 8/1977 Dyess ..... A63B 67/06 273/338
4,120,499 A * 10/1978 Stazzone ..... A63B 67/06 273/338
4,198,048 A * 4/1980 Rathert ..... A63B 67/06 273/339
D288,828 S * 3/1987 Romestan ..... D21/304
6,135,455 A * 10/2000 McNally ..... A63B 67/06 273/336
6,241,251 B1 * 6/2001 Trifonov ..... A63B 67/06 273/339
2010/0176554 A1 * 7/2010 Godwin ..... A63B 71/0036 273/338

* cited by examiner

*Primary Examiner* — Sunit Pandya
(74) *Attorney, Agent, or Firm* — James R. McDaniel

(57) ABSTRACT

An apparatus and method of play for a ring tossing game. The apparatus includes targets with a plurality of mounted pegs and annular rings. When the ring tossing game is played the targets are placed at a distance from each other and the rings are tossed at each of the targets, in turn; in an attempt to score by landing a ring around any of the targets' mounted pegs, with each toss being scored and a winner being declared when one of the two opponents reaches a score of exactly twenty-one or hits each of the four corner pegs with each of the four rings in the same turn without opponent canceling out a score.

1 Claim, 2 Drawing Sheets

RING TOSSING GAME AND GAME APPARATUS

BACKGROUND OF THE INVENTION

Field of the Invention

The present invention relates to a game of skill which consists of rings being tossed at one or more targets and more particularly to the construction of the equipment including the targets and rings for use in such game, and a method of play, more particularly, to a ring toss game.

Description of the Prior Art

U.S. Design Pat. No. D478,357 issued Aug. 12, 2003 to Thomas A. Penna, discloses an ornamental design for a ring toss game utilizing rings which have a determined point value and two pegs which are inserted into a playing field.

U.S. Design Pat. No. D462,092 issued Aug. 27, 2002 to Brian Temple, discloses an ornamental design for a ring toss game utilizing targets which have three open holes vertically aligned to receive circular rings shown.

U.S. Design Pat. No. 257,745 issued Dec. 30, 1980 to Adolph Abraham, discloses an ornamental design for a ring toss game target which consists of three pegs attached to the top of the target in a triangular arrangement.

U.S. Pat. No. 10,166,451 issued Jan. 1, 2019 to Randolph G. Laskowitz, discloses a ring toss game consisting of a perpendicular object tube in the center of first square tray which rings may be tossed in a game of skill.

U.S. Pat. No. 7,802,795 issued Sep. 28, 2010 to Daniel M. Bos, discloses a portable horseshoe game suitable for use in connection with an existing bags game.

U.S. Pat. No. 4,198,048 issued Apr. 15, 1980 to Larry F. Rathert, discloses a ring toss game consisting of a base which is cruciform in shape and embedded in the ground, with at least one peg angled toward the center of the base.

U.S. Pat. No. 4,045,028 issued Aug. 30, 1977 to Lonnie V. Dyess, discloses a game target with adjustable pins with the game boards fitting together for compact storage and transportation. Presently, none of the above inventions and patents, taken either singly or in combination, is seen to describe this instance of the invention as claimed.

SUMMARY OF THE INVENTION

An equipment system consisting of multiple targets and rings, the manner in which the equipment system is produced, and method of play which will allow for play of a ring toss game.

DETAILED DESCRIPTION

Figure 3:
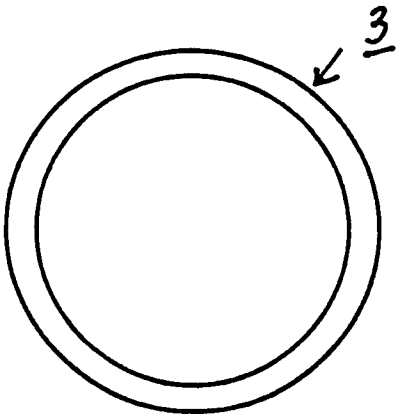
Figure 2:
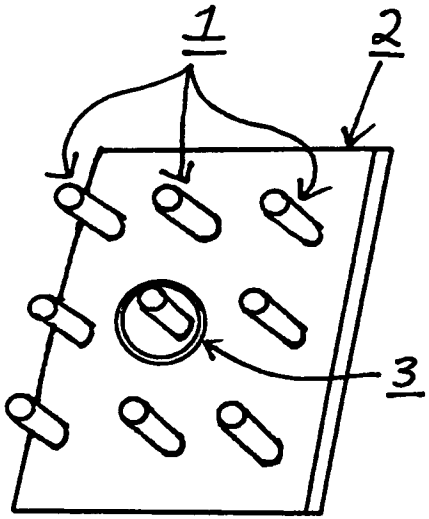
FIG. 2—Front/Right view of target (2) for ring toss game, pegs (1), and ring (3), according to a first embodiment, FIG. 3 —Top view of ring (3), FIG. 4—Back/Left view of target (2), pegs (1), components for supporting legs (4)(9), supporting legs (5), according to a second embodiment, FIG. 5—Back view of target (2), peg components for attachment to target (6), alternative supporting legs (8), alternative components for supporting legs (7) (14), according to a third embodiment, FIG. 6—Back/Left view of target (2), pegs (1), alternative support structure (10) (11), according to a fourth embodiment, FIG. 7 —Back/Left view of target (2), pegs (1), alternative supporting legs (12), alternative peg insertion element (13), according to a fifth embodiment.
Figure 1:
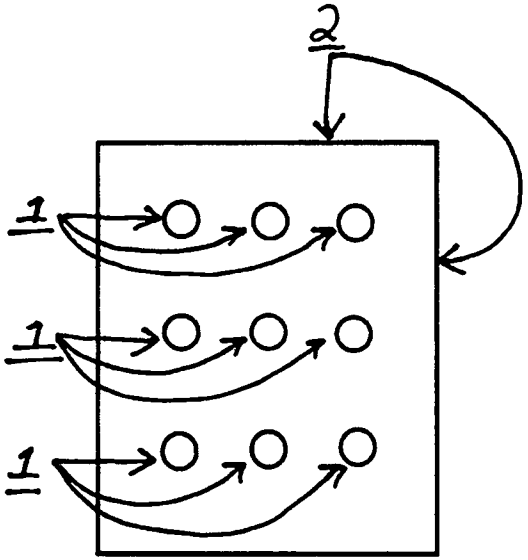
FIG. 1—Front view of target (2) for ring toss game and pegs (1)
Figure 6:
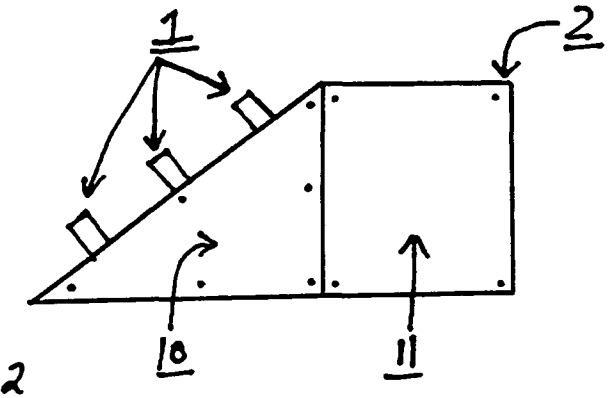
Figure 5:
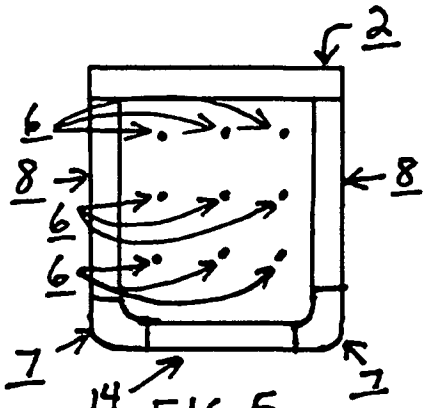
Figure 7:
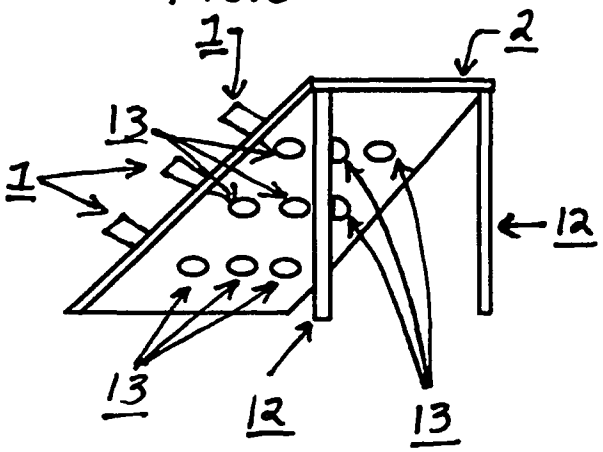
Figure 4:
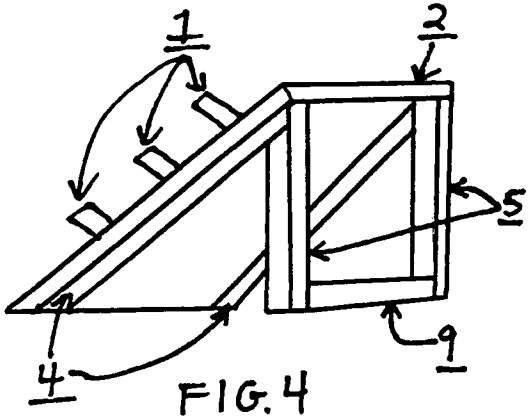

Preferably, the target base will be approximately 34" in length and 22" in width.

Preferably, each target will consist of nine pegs that will be approximately 5" in length from top to bottom with an approximate circumference of one and one-fourth inches.

Preferably, nine pegs will attach into or to each of the two target's top side in both three columns and three rows.

Preferably, this will consist of a middle column of three pegs which are all ten inches from the side of the target width-wise, with two columns of three pegs each on both sides of the middle column six inches apart.

Preferably, three pegs will make up a middle row approximately 17" from the bottom of the target top, with two rows of three pegs each both 9" above and below the middle row.

Preferably, both the bottom row of three pegs and the top row of three pegs will be 8" from both the bottom and top of the target, respectively.

Preferably, the target will be approximately half inch in thickness, with two supporting legs, one in each corner of the back of the target base approximately 22¾" in length.

Preferably, there will be 8 rings in total, four used by each player or team that will be approximately 6" in diameter and 1¼" in circumference.

Preferably, the fronts of each target will face each other and have a distance of nine feet between said targets when measured from the bottom of each target, with players or team members not crossing the closest point of target to toss rings to opposite target.

Preferably, when a ring is thrown over a peg and the peg penetrates the center of the ring causing the ring to remain around it, it will be counted as a score.

Preferably, the top row of three pegs will count for three points each, the middle row of three pegs will count for two points each, and the bottom row of three pegs will count for one point each.

Preferably, if during a player or teams' turn their three rings are thrown around three different pegs on the target in a row, either horizontally, vertically, or diagonally, the player or team will double the points scored.

Preferably, if during a player or team's turn their four rings are thrown around the four corner pegs on the target area, the team will automatically win the game.

Preferably, each time a player or team tosses their ring onto the same peg that the opposite player or team has scored points on, the scored points will cancel out.

Preferably, when beginning the game to determine the order of tossing, each team will choose one player.

Preferably, all four rings will be tossed by the player chosen for each team, adding the total points scored without using the ability to cancel scored points, with the highest point scoring team tossing first to begin the game.

Preferably, when individuals play each other, both players will play from the same target and toss to the opposite target.

Preferably, when teams consist of two players each, one player from each team will be positioned at each of the targets, tossing rings to the opposite target from where they are positioned.

Preferably, the game will continue until one player or team scores exactly 21 points or tosses all four rings around each of the four corner pegs.

Preferably, if any player or team scores more than 21 points at the end of a turn, the player or teams' score will remain what it was at the beginning of the turn.

Preferably, if there is a tie at the end of the turn where both players or both teams score exactly 21 points, both players or both teams' score will remain what it was at the beginning of the turn. Preferably, this will continue until a winner is determined when only one player or team scores exactly 21 points.

The invention claimed is:

1. A method of playing a ring toss game wherein the game is played by at least a first player and a second player, comprising the steps of:

(a) arranging a first device a distance apart from the first player and the second player or arranging a first and second device a distance apart from the first player and the second player, wherein the devices face each other and each device comprises a target and pegs operatively connected to the target;

(b) positioning the first and second player a distance apart from the first device or positioning the first and second player behind the first device while throwing a plurality of rings at the second device;

(c) alternatively throwing the plurality of rings at the first device or alternating positioning from the first device to the second device by the first and second player;

(d) if necessary, tallying at least a point based on the throws by the first and second player if at least one of the rings remains penetrated by the peg at end of a turn by the first and second player;

(e) if necessary, cancelling the at least one point if either the first or second player's rings remain penetrated by the peg and remain around the peg that the opposite player has scored at least a point on;

(f) if necessary, declaring the first or second player a winner based on the throws by the first or second player if the plurality of rings remain penetrated by a peg located at each of the four corners of a rectangular pattern formed by the pegs on the target and remain around the four corner pegs without the opposite player's ring(s) remaining penetrated by any of each of the four corner pegs; and (g) repeating steps (b) through (f) in alternating fashion until a score is reached to determine winner.

* * * * *